US007963733B2

(12) United States Patent
Marsh

(10) Patent No.: US 7,963,733 B2
(45) Date of Patent: Jun. 21, 2011

(54) APPARATUS FOR AND A METHOD OF BINDING OF A PERFECT BOUND BOOK

(75) Inventor: Jeffrey D. Marsh, Foristell, MO (US)

(73) Assignee: Perfect Systems, LLC, Foristell, MO (US)

( * ) Notice: Subject to any disclaimer, the term of this patent is extended or adjusted under 35 U.S.C. 154(b) by 0 days.

(21) Appl. No.: 12/543,342

(22) Filed: Aug. 18, 2009

(65) Prior Publication Data

US 2010/0080668 A1 Apr. 1, 2010

Related U.S. Application Data

(60) Provisional application No. 61/101,822, filed on Oct. 1, 2008, provisional application No. 61/234,800, filed on Aug. 18, 2009, provisional application No. 61/234,882, filed on Aug. 18, 2009.

(51) Int. Cl.
*B42C 9/00* (2006.01)
*B05C 1/08* (2006.01)

(52) U.S. Cl. ..... 412/37; 412/33; 118/118; 118/242; 118/261; 118/262

(58) Field of Classification Search ..... 412/8, 37, 412/33, 13, 14, 11, 901; 156/389; 118/118, 118/241, 242, 261, 262
See application file for complete search history.

(56) References Cited

U.S. PATENT DOCUMENTS 1,003,679 A 9/1911 Welch
1,076,726 A 10/1913 Welch
(Continued)

FOREIGN PATENT DOCUMENTS

EP 0390734 8/1990
(Continued)

OTHER PUBLICATIONS

BQ-150 Book Binder Brochure, Published prior to Aug. 18, 2008.

(Continued)

*Primary Examiner* — Dana Ross
*Assistant Examiner* — Pradeep C Battula
(74) *Attorney, Agent, or Firm* — Polster Lieder Woodruff & Lucchesi, L.C.

(57) ABSTRACT

Apparatus for binding perfect bound books of different thickness is disclosed where the amount of adhesive applied to the spine of the book block may be varied in relation to the thickness of the book block. An adhesive application station is provided which has a rotary driven adhesive application wheel partially immersed in a bath of a liquefied adhesive such that as a portion of the wheel rotates up out of the adhesive, the periphery of the wheel is coated with a layer of adhesive. An area of increased thickness of the adhesive if formed adjacent the top of the wheel so that upon effecting relative movement of the book block and the adhesive application station, adhesive is applied to the spine of the book block. The thickness of the layer of adhesive applied to the spine of the book block may be varied in relation to the thickness of the book block generally in accordance with the formula AT=b+mX, where AT is the adhesive thickness, b is the width of an initial gap between the topmost surface of the wheel and the spine, and where mX is a function of the number of sheets making up the book block, or is a function of the measured thickness of the book block.

3 Claims, 9 Drawing Sheets

U.S. PATENT DOCUMENTS

| | | | | |
|---|---|---|---|---|
| 1,088,573 | A | 2/1914 | Heldmann | |
| 1,635,165 | A | 7/1927 | Adamsky | |
| 1,704,454 | A | 3/1929 | Ackley | |
| 1,757,623 | A | 5/1930 | Frazier | |
| 2,895,148 | A | 7/1959 | Hildmann | |
| 3,093,396 | A | 6/1963 | Segreto | |
| 3,532,363 | A | 10/1970 | Abildgaard et al. | |
| 3,570,350 | A | 3/1971 | Fogg | |
| 3,575,501 | A | 4/1971 | Rosenberg | |
| 3,633,727 | A | 1/1972 | Brenner | |
| 3,797,362 | A | 3/1974 | Heckman | |
| 3,888,150 | A | 6/1975 | Stroud | |
| 3,905,531 | A | 9/1975 | Aspinwall | |
| 3,925,126 | A | 12/1975 | Leatherman et al. | |
| 3,925,926 | A | 12/1975 | Shigeo | |
| 3,956,053 | A | 5/1976 | Staats | |
| 3,957,287 | A | 5/1976 | Hall et al. | |
| 3,973,787 | A | 8/1976 | Staats et al. | |
| 3,982,744 | A | 9/1976 | Kraynak et al. | |
| 4,075,726 | A | 2/1978 | Korsgaard | |
| 4,149,288 | A | 4/1979 | Sendor et al. | |
| 4,184,218 | A | 1/1980 | Hawkes | |
| 4,289,330 | A | 9/1981 | Wiermanski | |
| 4,296,294 | A | 10/1981 | Beckert et al. | |
| 4,367,061 | A | 1/1983 | Wiholm | |
| 4,420,282 | A | 12/1983 | Axelrod | |
| 4,436,469 | A | 3/1984 | Kelly | |
| 4,484,501 | A | 11/1984 | Ramcke | |
| 4,496,617 | A | 1/1985 | Parker | |
| 4,507,037 | A | 3/1985 | Fenimore | |
| 4,518,157 | A | 5/1985 | Stobb | |
| 4,528,643 | A | 7/1985 | Freeny, Jr. | |
| 4,556,353 | A | 12/1985 | Ehlermann | |
| 4,606,387 | A | 8/1986 | Weislogel et al. | |
| 4,715,758 | A | 12/1987 | Stobb | |
| 4,839,829 | A | 6/1989 | Freedman | |
| 4,863,191 | A | 9/1989 | Termanis | |
| 4,922,773 | A | 5/1990 | Ito | |
| 4,923,351 | A | 5/1990 | Nishikawa | |
| 5,006,396 | A | 4/1991 | VanBortel et al. | |
| 5,009,138 | A | 4/1991 | Rettie | |
| 5,108,244 | A | 4/1992 | Bellanca | |
| 5,137,409 | A | 8/1992 | Honegger | |
| 5,213,461 | A | 5/1993 | Kalisher | |
| 5,240,362 | A | 8/1993 | Nakayama et al. | |
| 5,259,285 | A | 11/1993 | Uchida | |
| 5,295,775 | A | 3/1994 | Andjelic et al. | |
| 5,304,050 | A | 4/1994 | Vismara | |
| 5,340,155 | A | 8/1994 | Podosek | |
| 5,345,045 | A | 9/1994 | Rohwedder | |
| 5,350,268 | A | 9/1994 | Muller | |
| 5,354,045 | A | 10/1994 | Boldrini et al. | |
| 5,374,050 | A | 12/1994 | Prim | |
| 5,417,535 | A | 5/1995 | Andjelic et al. | |
| 5,465,213 | A | 11/1995 | Ross | |
| 5,496,253 | A | 3/1996 | Snellman et al. | |
| 5,536,044 | A | 7/1996 | Luhman et al. | |
| 5,547,176 | A | 8/1996 | Williams et al. | |
| 5,569,012 | A | 10/1996 | Kosasa et al. | |
| 5,632,587 | A | 5/1997 | Coyette | |
| 5,647,714 | A | 7/1997 | Lundberg | |
| 5,647,715 | A | 7/1997 | Stolz | |
| 5,660,515 | A | 8/1997 | Hartsoe | |
| 5,724,075 | A | 3/1998 | Smith | |
| 5,820,325 | A | 10/1998 | Hartsoe | |
| 5,850,774 | A | 12/1998 | Naldi | |
| 5,868,539 | A | 2/1999 | Rathert | |
| 5,871,323 | A | 2/1999 | Clark | |
| 5,874,812 | A | 2/1999 | Chang | |
| 5,904,084 | A | 5/1999 | Weston | |
| 5,924,349 | A | 7/1999 | Perazzolo | |
| 5,988,620 | A | 11/1999 | Graushar | |
| 6,012,367 | A | 1/2000 | Westra et al. | |
| 6,012,840 | A | 1/2000 | Small, IV et al. | |
| 6,012,890 | A | 1/2000 | Garrido | |
| 6,017,027 | A | 1/2000 | Jaeger | |
| 6,017,029 | A | 1/2000 | Bates et al. | |
| 6,142,721 | A | 11/2000 | Marsh | |
| 6,193,458 | B1 | 2/2001 | Marsh | |
| 6,206,358 | B1 | 3/2001 | Yamaguchi et al. | |
| 6,213,703 | B1 | 4/2001 | Garrido | |
| 6,416,082 | B1 | 7/2002 | Gayoso | |
| 6,460,843 | B1 * | 10/2002 | Dim et al. | 412/16 |
| 6,928,914 | B2 | 8/2005 | Marsh | |
| 7,014,182 | B2 | 3/2006 | Marsh | |
| 2002/0034428 | A1 * | 3/2002 | Marsh | 412/16 |
| 2002/0061241 | A1 * | 5/2002 | Fischer et al. | 412/37 |
| 2002/0064437 | A1 * | 5/2002 | Kuramoto et al. | 412/37 |
| 2006/0029445 | A1 | 2/2006 | Nakamura et al. | |
| 2007/0035081 | A1 | 2/2007 | Kaneko et al. | |
| 2007/0036637 | A1 | 2/2007 | Hata et al. | |
| 2007/0045920 | A1 | 3/2007 | Yoshie et al. | |
| 2007/0122256 | A1 | 5/2007 | Toyoizumi et al. | |
| 2007/0286706 | A1 * | 12/2007 | Takagi | 412/37 |
| 2008/0003080 | A1 * | 1/2008 | Abegglen et al. | 412/37 |
| 2008/0112778 | A1 * | 5/2008 | Hattori | 412/37 |
| 2009/0035095 | A1 * | 2/2009 | Takano et al. | 412/37 |

FOREIGN PATENT DOCUMENTS

| | | |
|---|---|---|
| JP | S61-97795 | 5/1986 |
| JP | 8-34190 | 2/1996 |
| JP | 08-276683 | 10/1996 |
| JP | 09076661 | 3/1997 |
| JP | 10-16431 | 1/1998 |
| JP | 11105455 | 4/1999 |
| JP | 11240670 | 9/1999 |
| JP | 3672719 | 7/2005 |
| WO | 9938707 | 8/1999 |
| WO | 00 0 3876 | 1/2000 |
| WO | 0066366 | 11/2000 |
| WO | 0245924 | 6/2002 |

OTHER PUBLICATIONS

Konica Minolta bizhub PRO C6500 Specification & Installation Guide, published prior to Aug. 18, 2008.

* cited by examiner

APPARATUS FOR AND A METHOD OF BINDING OF A PERFECT BOUND BOOK

CROSS-REFERENCE TO RELATED APPLICATIONS

This application claims the benefit of priority of pending U.S. Provisional Patent Application 61/101,822, filed Oct. 1, 2008, and U.S. Provisional Patent Applications 61/234,800 and 61/234,882, filed Aug. 18, 2009, now PCT/US10/45708, filed Aug. 17, 2010, and U.S. patent application Ser. No. 12/576,923 having a §371(e) date of Oct. 9, 2009, and incorporated by reference in their entirety herein.

STATEMENT REGARDING FEDERALLY SPONSORED RESEARCH OR DEVELOPMENT

Not Applicable.

BACKGROUND OF THE DISCLOSURE

In recent years, print on demand (POD) book printing, binding and trimming systems (POD book publishing systems) have been developed, such as shown in my U.S. Pat. No. 7,014,182. This last-mentioned patent used one or more conventional black and white duplex laser printers for printing the text pages that constituted the book block of the POD book. A color cover for such POD books was also conventionally printed by a cover printer was married to the book block to form a perfect bound book. In recent years, advances have been made in color printers such that those skilled in the art will recognize that such modern color printers can economically used to print the text pages of a POD either in black and white, or in color.

While such print on demand book printing, binding and trimming apparatus, as described in my above-noted U.S. Pat. No. 7,014,182, worked well, it was found that certain problems arose in adhesively binding the cover to the spine of the book block. The amount of the adhesive applied to the spine of the book block was the same for thin book blocks and for thick book blocks. On thinner book blocks, excess adhesive was oftentimes applied to the spine such that when the cover was bound to the spine, such excess adhesive was forced from between the spine and the inside of the cover in contact with the spine and this excess adhesive flowed onto the face of the book block proximate the spine and onto the inside faces of the cover proximate the spine. While some such excess adhesive may be desirable because it held the cover in a flat condition against the outer pages of the book block, if too much adhesive was present between the cover and the face of the book block proximate the spine, this excess adhesive would form a ridge in the cover giving the book a pronounced "widow mark" (i.e., an indentation and a corresponding ridge formed on the cover along the spine) when the binding clamp gripped the cover and the book block adjacent the spine. While such books were still usable, they gave the book an appearance deficiency and made it difficult for the book to remain in an open position. Still further, such excess adhesive may form a pronounced ridge that cause the cover to bulge adjacent the spine and this may result in a book perceived to be of inferior quality.

As shown in FIGS. 1 and 2 of my above-noted U.S. Pat. No. 7,014,182, an adhesive application station AS was provided along the workpath WP. The adhesive application station had a rotary adhesive application wheel or drum that was at least partially immersed in a bath of hot melt adhesive that was heated to a desired application temperature (e.g., about 350-400° F., depending on the characteristics of the particular adhesive being used) sufficient to liquefy the hot melt adhesive. The wheel was rotatably driven about a horizontal axis generally perpendicular to the direction of relative movement between the book block and the wheel. As the wheel rotated up out of the bath of the liquefied adhesive, the peripheral edge of the wheel picked up a quantity of the adhesive thereon. The bottom edge of the spine was positioned so as to have an operatively relationship with the upper peripheral surface of the wheel (i.e., to be clear of the wheel but to be in contact with the layer of adhesive on the wheel) as the book block moved relative to the wheel so that a coating of the adhesive was applied across the width of the spine and along the length of the spine. However, the amount of adhesive carried by the wheel and applied to the spine could not be controlled and thus the same amount (thickness) of adhesive was applied to the spine, regardless of the thickness (width) of the spine. Counterintuitively, this has been found to result in excess adhesive being applied to thicker book blocks and insufficient adhesive applied to thinner book blocks.

SUMMARY OF THE DISCLOSURE

Apparatus for binding a perfect bound book is disclosed where the book has a book block and a cover adhesively bound to one edge of the book block, the one edge of the book block constituting the spine of the book block. The book block has a plurality of sheets of paper onto which the text of the book has been printed. The cover is adapted to wrap around the spine and to be adhesively adhered to the spine. More specifically, the apparatus disclosed herein comprises a fixture receiving the sheets of paper and forming the book block on the fixture. A first clamp is provided for holding the book block relative to the fixture with the spine of the book block exposed for the application of adhesive thereto and for adhesively binding the spine to a cover. An adhesive application station applies adhesive to the spine of the book block. The fixture is movable from a first position in which the fixture is positioned to receive the sheets to a second position in which the book block held by the first clamp is positioned relative to the adhesive application station for the application of adhesive to the spine. A drive is provided for moving the adhesive application station relative to the book block for the application of adhesive to the spine of the book block. Further, the fixture with the book block held thereby by the first clamp is selectively movable toward and away from an adhesive applicator member so as to vary the thickness of the coating of adhesive applied to the spine by the applicator member in relation to the thickness of the book block being bound. Specifically, the adhesive thickness applied to the spine may be varied in response with the thickness of the book block in accordance with the following relationship: $AT=b+mX$, where AT is the adhesive thickness, b is the minimum gap between the spine of the book block and the top of the adhesive application member (e.g., a wheel) for a book block of a minimum thickness (e.g., the book block have about 25 sheets of paper), and where mX is the thickness of the book block.

In another embodiment disclosed herein, apparatus for binding a perfect bound book is disclosed. This embodiment comprises a first clamp for holding the book block with the spine of the book block exposed. An adhesive application station is provided for applying adhesive to the spine of the book block upon relative movement of the book block and the adhesive application station. The adhesive application station has an adhesive reservoir in which is contained a supply of a suitable liquefied adhesive (preferably, but not necessarily, a hot melt adhesive). An adhesive application wheel is partially immersed in the adhesive in the reservoir with the wheel being rotary driven about its central axis. The wheel has a peripheral surface carries a coating of the liquefied adhesive thereon as the wheel rotates up out of the adhesive in the reservoir. The top surface of the wheel and the spine have a variable operative relation relative to one another for the application of adhesive to the spine in response to the thickness of the book block so that the amount of adhesive may be varied in relation to the thickness of the book block within a range of book block thicknesses ranging from a minimum thickness to a maximum thickness. The variable operative relation comprises a gap between the top of the wheel and the spine where the gap may range between a minimum gap corresponding to an operative position for applying adhesive to a book block of the minimum thickness (e.g., about 25 sheets in the book block) and an increased gap corresponding to an operative position for applying adhesive to a book block of the maximum thickness (e.g., about 400-500 or more sheets in the book block). A drive is provided for moving the first clamp and the spine of the book block carried by the first clamp vertically toward or away from the wheel in response to the thickness of the book block to which adhesive is to be applied. The mathematical relationship between the operative positions for applying the adhesive for book blocks ranging between the noted the minimum thickness book and the noted maximum thickness may be as described above.

A method of binding a perfect bound book is also disclosed including, but not limited to, the following steps. The sheets of paper are accumulated in a fixture so as to form the book block. The sheets are positioned in the fixture so that the spine and one side of the book block are accurately positioned relative to the fixture. The book block is clamped in position with respect to the fixture. Then, the book block is moved toward an adhesive application station. With the book block positioned at an operative position with respect to the adhesive application station, the adhesive application station is moved relative to the book block for the application of adhesive to the spine.

Further in accordance with the method of this disclosure, the operative relationship between the spine of the book block being bound and the adhesive application station may be varied in relation to the thickness of the book block of the book to be bound within a range of book block thicknesses ranging between a minimum thickness and a maximum thickness. More specifically, the operative relation between the spine of the book block being bound and the wheel is a gap therebetween, where the method includes varying the gap between a minimum gap corresponding to an operative position for applying adhesive to the spine of a book block of the minimum thickness and an increased gap correspond to an operative position for applying adhesive to the spine of a book block of the maximum thickness. Still further in accord with this method, the thickness of the adhesive applied to the spine of the book block in accordance with the relationship $AT=b+mX$, where AT is the adhesive thickness, b is the minimum gap between the spine of the book block and the wheel, and where mX is a function of the thickness of the book block.

Other objects and features of the disclosure will be in part apparent and in part pointed out hereinafter.

BRIEF DESCRIPTION OF THE DRAWINGS

Corresponding reference characters indicate corresponding parts throughout the several views of the drawing.

DESCRIPTION OF PREFERRED EMBODIMENTS

Figure 1:
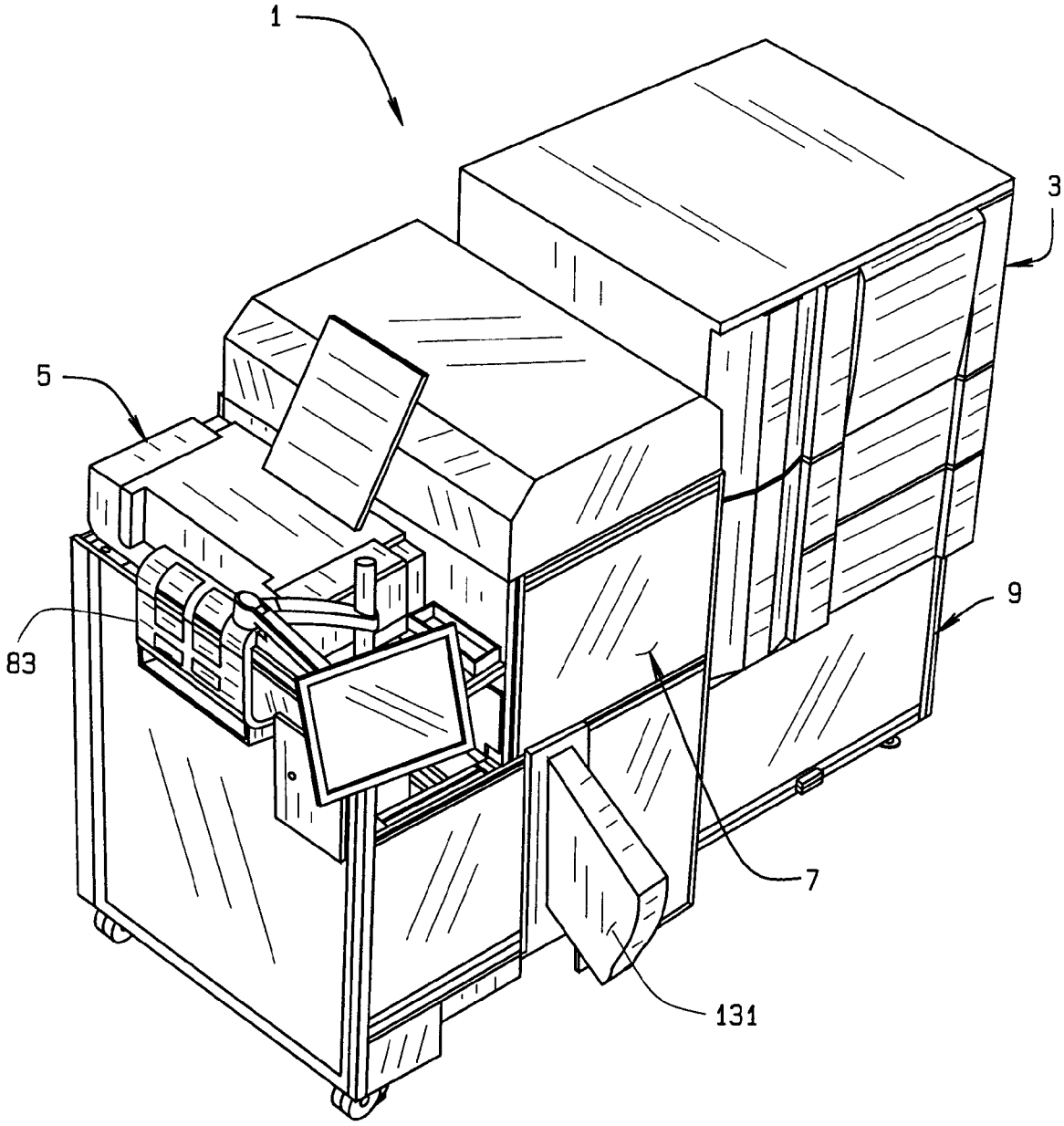
FIG. 1 is a perspective view of a print on demand (POD) book printing, binding and trimming apparatus of the present disclosure.

Referring now to the drawings and particularly to FIG. 1, apparatus for printing, binding and trimming print on demand (POD) books of the present disclosure is indicated in its entirety at 1. This apparatus is shown to have a text page printer 3, a cover printer 5, and a binding and trimming module 7. Page printer 3 is preferably a duplex printer capable of printing the pages of the book on one or both sides of sheets of paper. It will be understood that one or both faces of a sheet in the book block may be blank. It will be further understood that the term "paper" as used herein would include not only paper in the ordinary sense of that word, but would also include sheets made of other suitable material, such as plastic film or the like. The page printer 3 may be a black and white or a color printer. Page printers of any number of manufacturers will work satisfactorily with apparatus 1. For example, a Model _____ from Xerox Corporation, of Rochester, N.Y., or BizHub models PRO C6500 and C652 from Konica Minolta have worked well. A color cover printer is preferred. The manufacturer and model of such cover printers is not an important feature of this disclosure. Both color laser printers of various manufacturers and ink jet printers of various manufacturers have been used to print the covers for such POD books.

Figure 3:
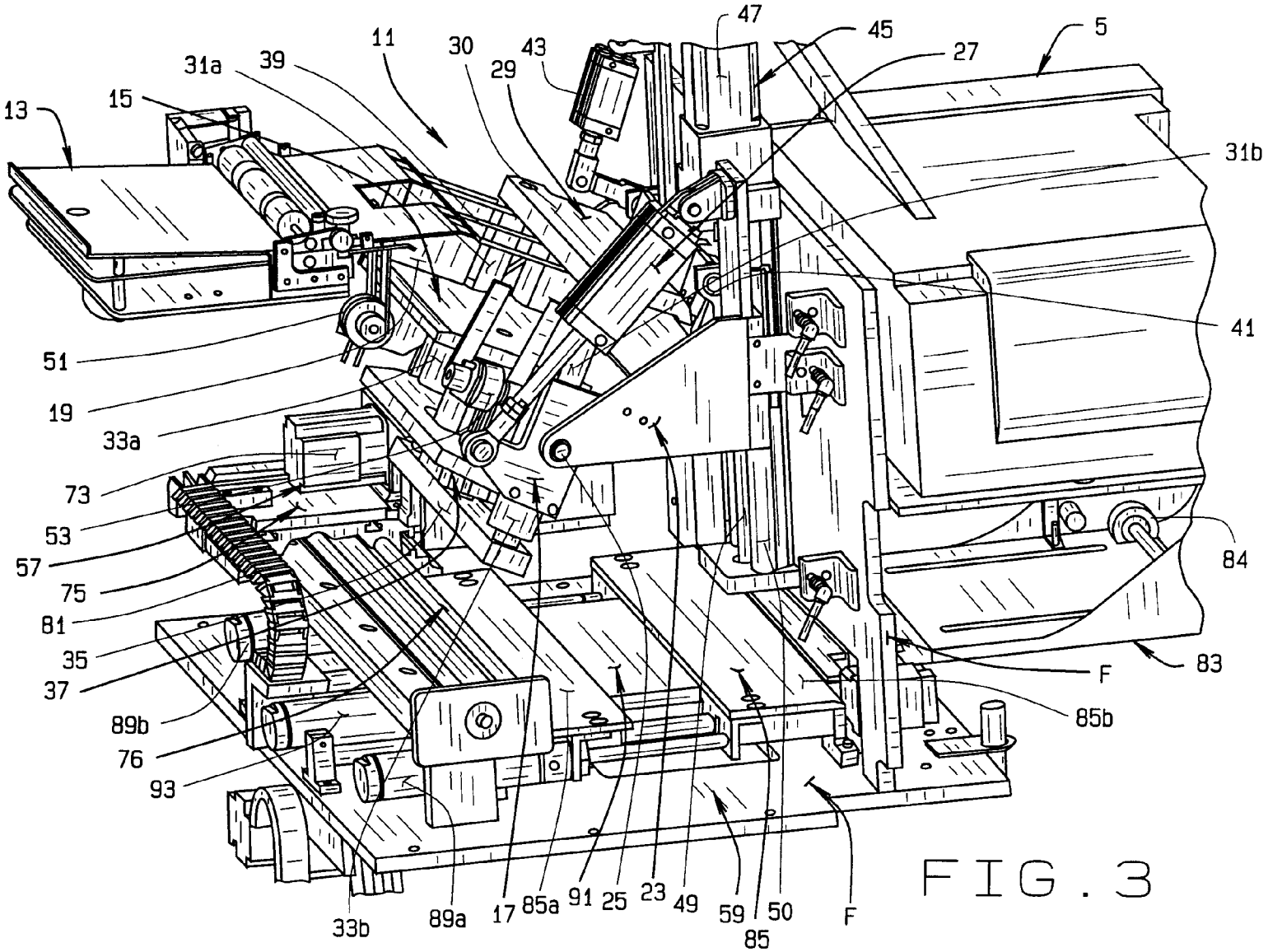
FIG. 3 is another perspective view of the page accumulator/fixture in its raised, page accumulation position illustrating an adhesive application station and a binding station therebelow.

As shown, the page printer 3 is positioned on a raised platform or cart 9 of such height that the sheets printed by the page printer and ejected therefrom are at a height so that the pages enter a page de-curler 13 (as shown in FIG. 3) and are discharged into an accumulator/fixture 11 where the text pages are accumulated so as to form a book block BB. It will be understood that if de-curler 13 is not needed, it may be omitted, so that the text pages may be discharged directly in the accumulator as they are ejected from the page printer. It will also be understood that if the discharge of the printed sheets from printer 3 is not at a height sufficient to match the entrance to de-curler 13, an appropriate conveyor (not shown) may be used to convey the sheets discharged from the printer to the de-curler or directly to the accumulator. As used herein, it will be understood that as the text pages of the book block BB are printed by printer 3, they are accumulated in accumulator 11 whether the de-curler is present or not.

By the term "text pages" it will be understood that this refers to the pages of a book B between the front and back cover of the book whether they have text, photos, or other figures printed thereon, or whether the pages are blank. The text pages may also include the title page, the table of contents, index, and appendices. As noted, page printer 3 is preferably a duplex printer that prints on both sides of the sheets of paper that make up the book block, but a simplex may be used as well. As used herein, the terms "text page", "page" and "sheet" may be used somewhat interchangeably, but it will be understood that generally there are only about half as many sheets of paper as there are pages in a book block BB because in a typical book block, each face of a sheet is referred to as a page. Book block BB is shown to be generally rectangular or square. As shown in FIG. 10 of U.S. Pat. No. 7,014,182, which is herein incorporated by reference in its entirety, the book block has major and minor sides with one of the major sides constituting spine S of the book block. Likewise, a perfect bound book B formed from book block BB is also rectangular. However, those skilled in the art will recognize that other polygonal shapes for a book block may be employed in accordance with this disclosure. It will be further understood that if the book block is square, the major and minor sides of such a square book block are of the same length. In such case, the spine may be along one of the sides of the square book block.

Figure 2:
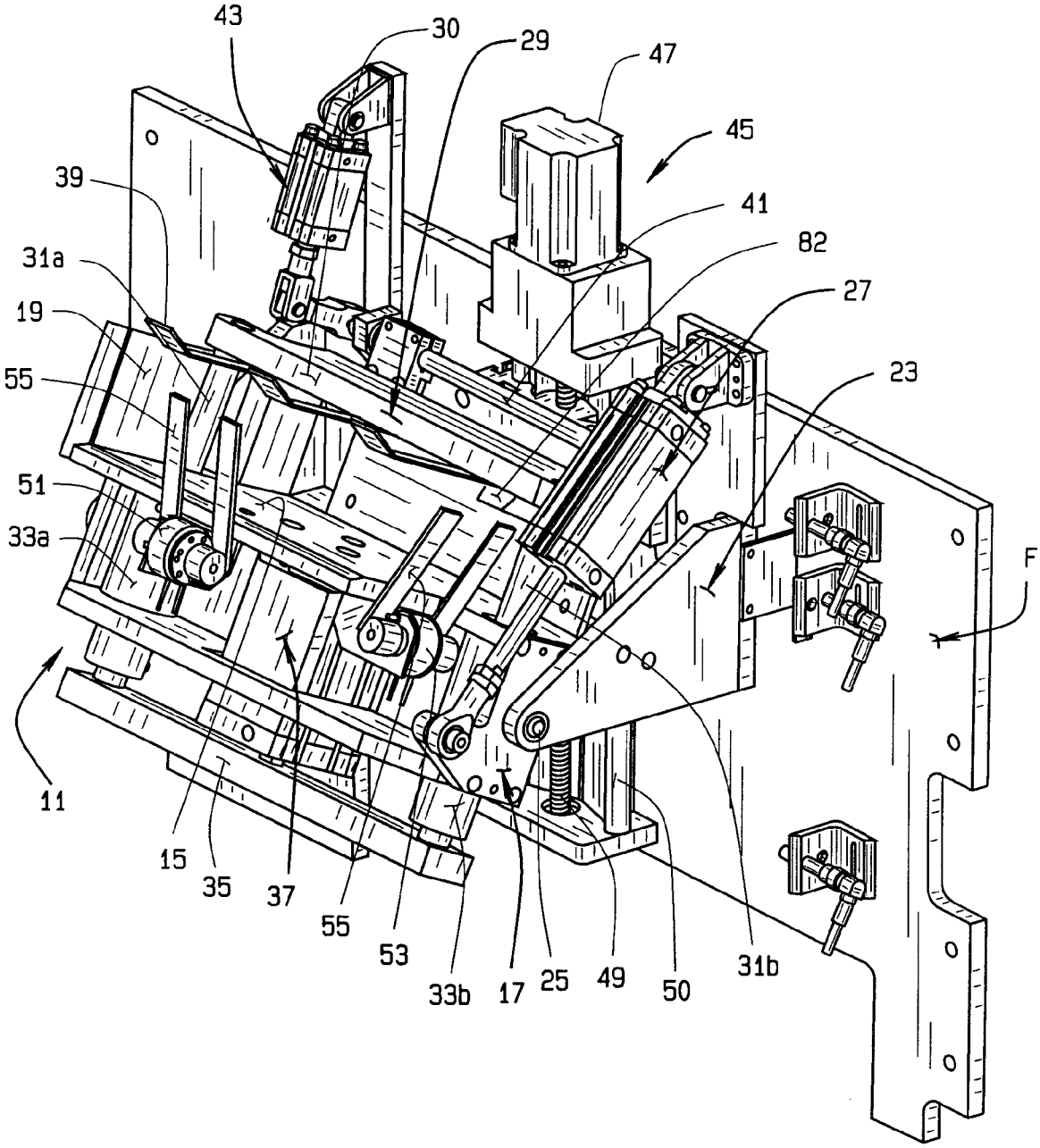
FIG. 2 is a perspective view of a page accumulator/fixture, which is part of the apparatus shown in FIG. 1, illustrated in its raised, page accumulation position for receiving pages printed by a page printer and for forming a book block thereon.
Figure 4:
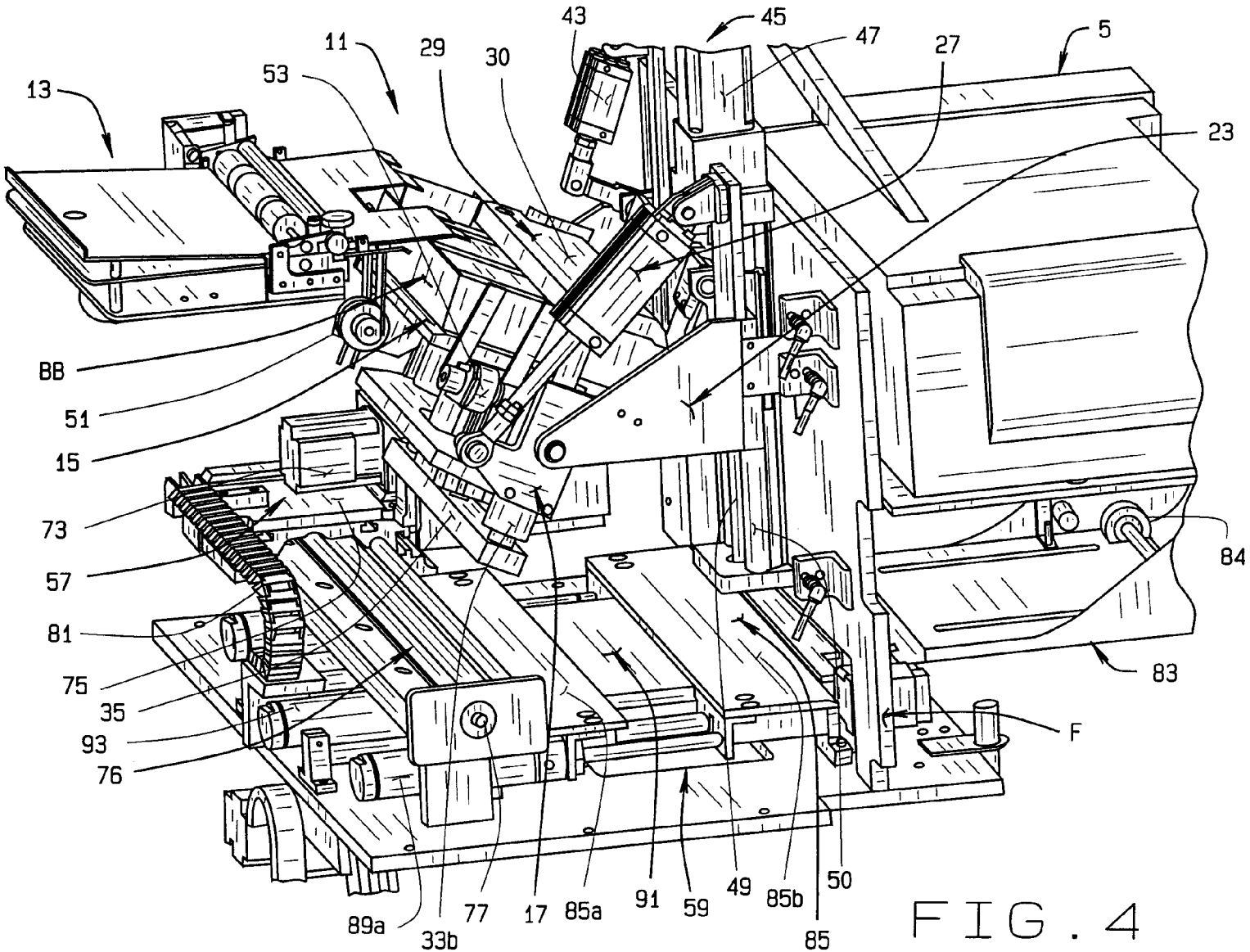
FIG. 4 is another perspective view of the accumulator/fixture similar to FIG. 3 showing the accumulation a book block in the accumulator/fixture, with one edge of the book block constituting the spine engageable with a book block stop plate and with another edge in engagement with a side of the accumulator such that the book block is accurately positioned in the accumulator/fixture.
Figure 5:
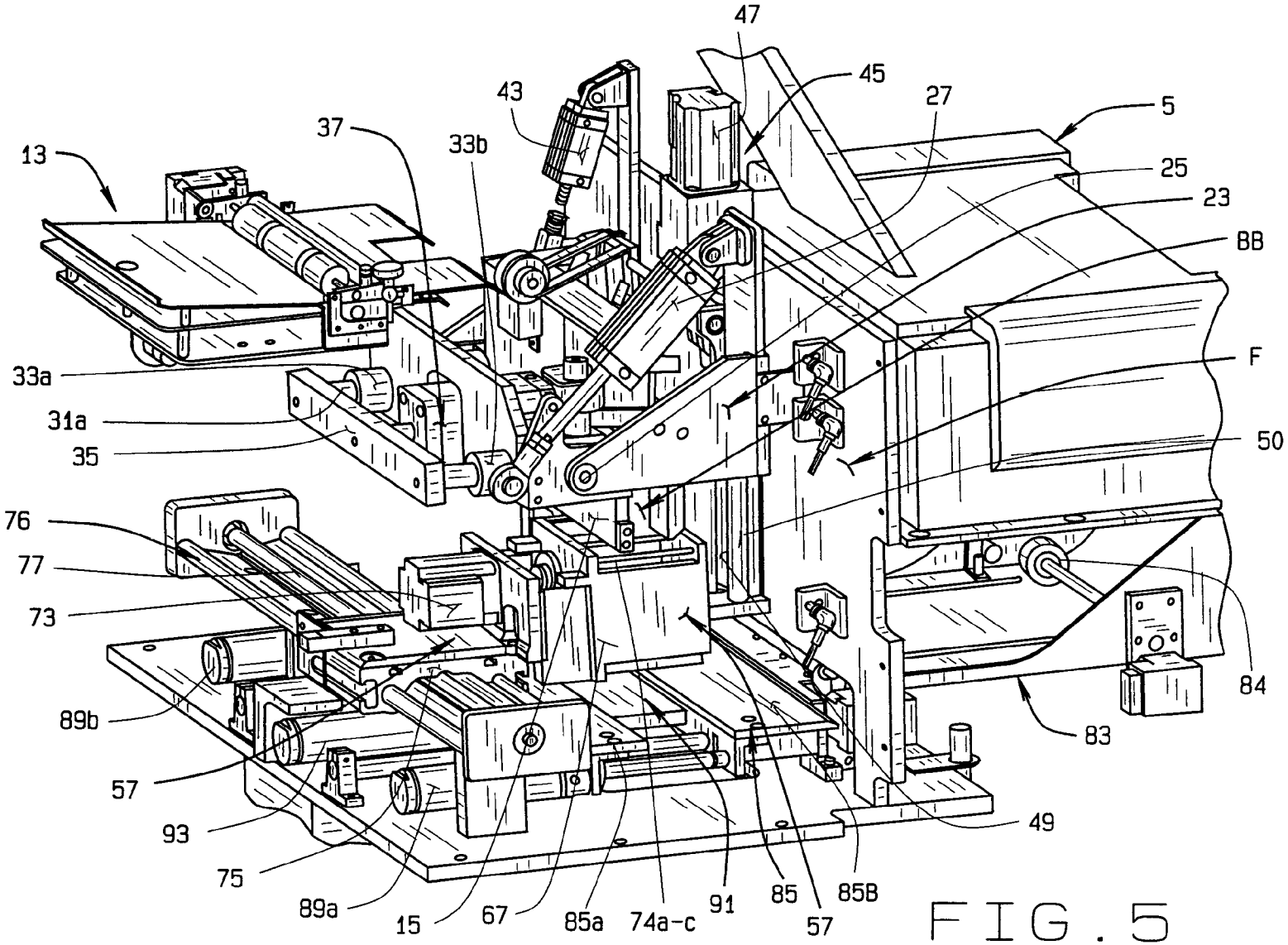
FIG. 5 is still another perspective view of the accumulator/fixture in which the book block has been clamped to the bed of the accumulator/fixture by an accumulator clamp, in which the book block stop plate has been moved to a retracted position, and in which the accumulator has been moved (rotated) to a second or vertical position in which the book block is vertical with the spine of the book extending below the fixture.

Referring now to FIGS. 2-5, the binding and trimming module 7 has a frame F upon which the major components are mounted. Specifically, module 7 has accumulator/fixture 11 (also referred to as a carriage) mounted on this frame F. The accumulator has an accumulator bed or tray 15 upon which the text pages of the book are accumulated as they are printed by page printer 3 and either ejected directly from the printer or passed through de-curler 13 and then discharged into the accumulator. Accumulator 11 has an accumulator frame, as generally indicated at 17 in FIG. 2. The accumulator bed 15 and a side member 19 are carried by the accumulator frame with the side member extending perpendicular to the bed at one side thereof. The accumulator frame 17 carries a stop plate 21 positioned at the end of bed 15 on the opposite side of the bed from where the text pages are ejected from de-curler 13 to as to provide a stop for the pages. Stop plate 21 is pivotally mounted with respect to accumulator frame 17 for movement between a first position (as shown in FIG. 2) in which the stop plate is positioned to be engaged by the edge of each text page (or sheet) as the pages are discharged or deposited into the accumulator and a retracted position (as shown in FIG. 5) in which the stop plate is clear of the one edge of the book block BB, this one edge constituting the book block spine S. With the stop plate in its retracted position and with the book block clamped to bed 15 (in the manner as will be described), the accumulator frame 17 may be rotated from its inclined position (as shown in FIGS. 2-4) to a vertical position (as shown in FIG. 5).

Figure 7:
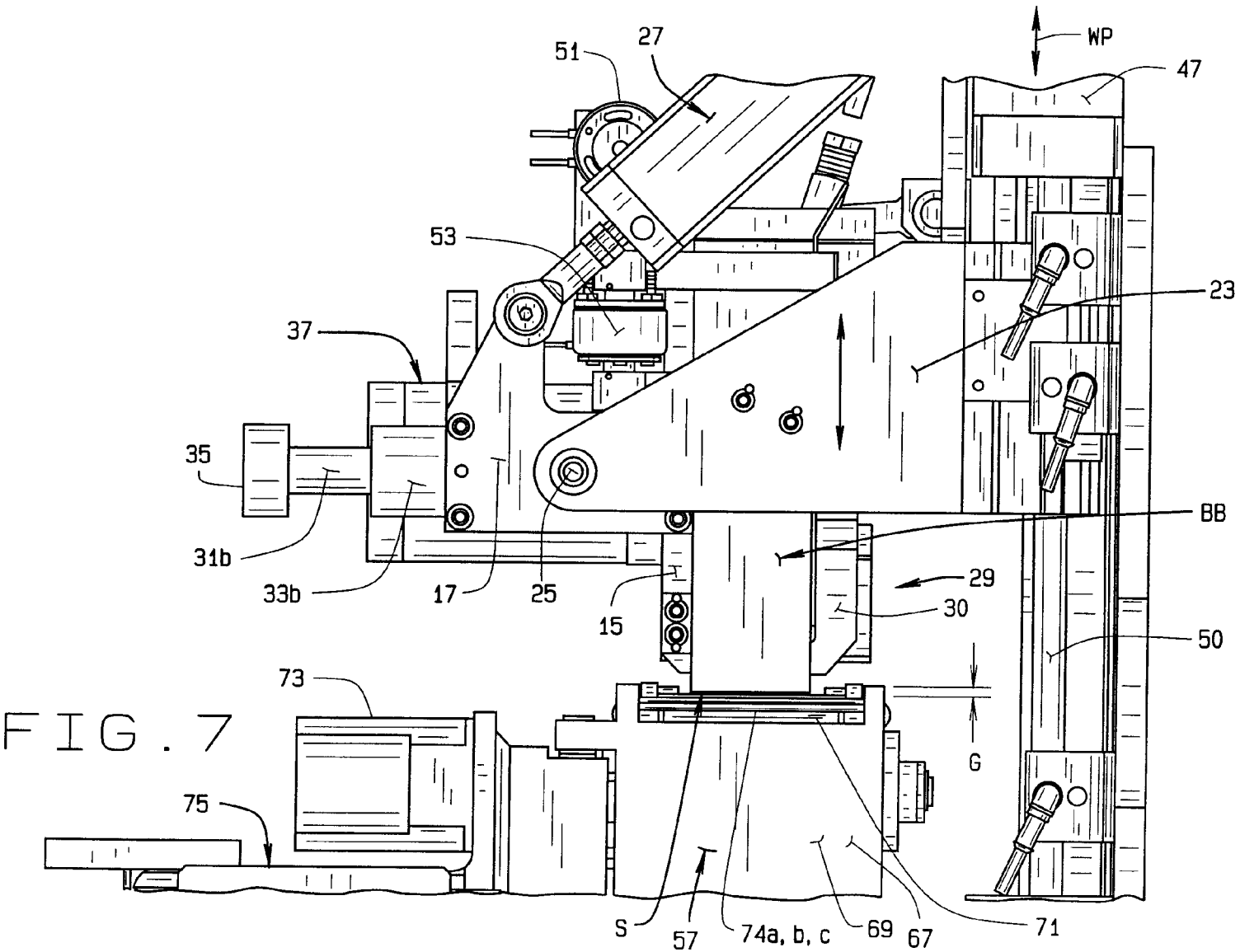
FIG. 7 is an right end elevational view of the accumulator/fixture and book block on a somewhat enlarged scale with the spine of the book block positioned at the adhesive application station for the application of adhesive to the spine with the spine spaced from the uppermost peripheral surface of the adhesive application drum by a gap.

More specifically, accumulator frame 17 is pivotally mounted within an accumulator mounting frame 23 for pivotal movement about pivot points 25 between the above-described first or inclined position (as shown in FIGS. 2-4) in which the accumulator (and particularly bed 15) is in position to receive and to accumulate the pages making up the book block BB., and a second or vertical position (as shown in FIGS. 5 and 7) in which the book block BB carried by the accumulator is in a generally vertical position for purposes as will appear. The accumulator frame 17 is moved between its first and second position by means of a fluid cylinder 27, preferably a pneumatic cylinder.

As generally indicated at 29, accumulator or carriage 11 is provided with an accumulator clamp for positively holding (clamping) the book block BB relative to the accumulator bed 15 as the accumulator rotates from its first to its second position. This accumulator clamp 29 is sometimes referred to as a first clamp and it holds the book block BB in a predetermined position in the accumulator or carriage 11 on bed 15 as the book block is transported to other stations along a work path WP, as indicated by an arrow in FIG. 7 and as will be described below.

Accumulator clamp 29 includes a clamp plate 30 engageable with the upper face of the book block BB when the accumulator is in its inclined position (as shown in FIG. 4) so as to firmly clamp the book block to bed 15. The accumulator clamp includes a track, preferably slide rods 31*a*, 31*b* (as best shown in FIG. 2), at each end of clamp bar 30. These slide rods are slidably received in respective guides 33*a*, 33*b* mounted to accumulator frame 17 for slidable movement of the clamp plate 30 relative to bed 15 between its open retracted position (as shown in FIGS. 2 and 3) in which the text pages are free to accumulate on bed 15 and its closed, clamping position (as shown in FIGS. 4, 5, and 7) in which the book block is firmly clamped to the bed. As best shown in FIG. 7, the spine S of the book block BB extends out beyond bed 15 and out beyond clamp plate 30 a short distance (e.g., about ⅜ inch or 9.5 mm.) so as to expose the spine for having adhesive applied thereto and to allow the spine to be adhesively bound to the cover. The outer ends of slide bars 31*a*, 31*b* are mounted to a cross bar 35. Clamp member 30 is moved from its open or retracted position to its closed clamping position by means of a fluid cylinder 37 mounted between bed 17 and cross bar 35 so that upon actuation of cylinder 37 so as to extend its actuator rod 38 (as best shown in FIG. 4), the cross bar is caused to move away from bed 17 which in turn forcibly moves the clamp member 30 toward the bed via slides 33*a*, 33*b* sliding along slide rods 31*a*, 31*b*. In this manner, the book block is firmly clamped by clamp member 30 to bed 15.

It will be understood that when accumulator stop plate 21 is in its stop position and as the pages are discharged into the accumulator/fixture 11, the leading edges of the pages will engage the stop plate and this the stop plate will determine the position of one edge (the spine S) of book block BB relative to the accumulator. As shown in FIG. 2, page guide fingers 39 are carried by clamp member 30 so as to insure that as the text pages are discharged into accumulator/fixture 11, the pages will be directed to be between the last placed page of the book block BB and the underside of the clamp member.

As previously noted, stop plate 21 is mounted for pivotal movement relative to bed 15 between an operative position in which the stop plate is in position to be engaged by an edge of each page of the book block BB as the pages are ejected from de-curler 13 into accumulator 11 and a retracted position (as shown in FIG. 5) in which the stop plate is clear of the spine of the book block. As best illustrated in FIG. 2, the stop plate 21 is carried on a rotatable shaft 41 which in turn is rotated by a fluid cylinder 43 (preferably an air cylinder) to selectively move the stop plate between its operative and retracted positions. Specifically, upon extending the actuator rod of cylinder 43, shaft 41 is forced to rotate the stop plate way from bed 15 thereby to expose spine S.

As generally indicated at 45, a drive is provided for moving accumulator/fixture 11 in a vertical direction from a first position, as shown in FIGS. 2-4, in which the bed 15 of the accumulator may be in its inclined position and/or in which bed 15 may be moved to its vertical position with book block BB held in place on the bed by accumulator clamp 29 to a first lowered position, as shown in FIGS. 5 and 7, in which the exposed spine S of the book block is positioned to have adhesive applied thereto at an adhesive application station 57, as will be described hereinafter. Still further, continued operation of drive 45 will lower the book block from the adhesive application station to a binding station, as indicated at 59. After binding, drive 45 may be further operated so as to lower the now bound book B from the binding station to a trimming station 61. This above-described vertical movement of the accumulator clamp constitutes the work path WP (as illustrated in FIG. 7) that has the above-noted stations therealong. This will be described in greater detail below.

Drive 45 includes a drive 47 (preferably a stepper gearmotor) that rotates a vertically disposed drive screw 49, which threadably engages accumulator frame 23 and thus effects vertical movement of the accumulator/fixture 11 along at least a portion of workpath WP. More specifically, upon operation of motor 47 in one direction, the drive screw moves the accumulator frame 23, the accumulator 11, and the book block BB held therein downwardly along the work path WP, and operation of the motor in the opposite direction moves the accumulator upwardly. Of course, upon de-energization of motor 47, the accumulator and the book block held thereby are effectively held stationary at any position along the workpath. Those skilled in the art will recognize that the weight of the accumulator on drive screw 49 is not sufficient to back-drive the motor thus locking the accumulator in place along the track 50. As indicated at 50, a vertical track is provided for accumulator mounting frame 23 for vertical movement along the workpath.

As best shown in FIG. 2, a page tapper 51 is provided for tapping each sheet (or small groups of sheets) delivered to the accumulator 11 so as to tap each sheet toward stop plate 21. Another page tapper 53 is provided to tap each sheet in sideways direction toward the fixed accumulator side 19. These tappers thus insure that each sheet (or group of sheets) of the book block BB is properly and evenly positioned on bed 15. With the sheets making up book block BB firmly against the stop plate and against the accumulator side, the book block is accurately positioned in accumulator 11 in a known position. Of course, with the book block in a known position in the accumulator, a computer control system CS of the apparatus also "knows" the position of the text printed on the pages and thus "knows" how much of the margins of the bound book must be trimmed to produce a trimmed book of a predetermined finished size. This known position of the book block BB is maintained by the accumulator clamp 29 as the book block is moved from the accumulator 11 in the position as shown in FIG. 2 to the adhesive application station 57 and then is moved to a the binding station or table 59. Further, in a manner as will be disclosed, the known position of the bound book is maintained in the trimming station so that the book may be trimmed to a predetermined finished size. The computer control system CS is not shown in the drawings, but it will be understood that such a computer control system may perform many of the functions described in the above-noted U.S. Pat. No. 7,014,182, which is herein incorporated by reference in its entirety. This computer control system may be mounted at any convenient location within apparatus 1. A preferred computer control system CS may be a programmable logic controller (PLC), such as a model IC200UDD064 VersaMax Micro PLC commercially available from GE Fanuc of Charlottesville, Va.

Tappers 51 and 53 are of similar construction and operation. These tappers comprise fingers 55 carried by a rotary solenoid motor energized after each sheet (or small group of sheets) has been delivered to the accumulator the fingers tap each sheet toward stop plate 21 and toward side 19 so as to insure all of the pages in book block BB are properly positioned relative to one another and to insure that none of the sheets of the book block hang up or are uneven. In this way, it is insured that as each sheet or each group of sheets or pages are deposited in the accumulator, these last deposited pages can be readily moved relative to the accumulator and to the previously deposited pages so that all of the pages of the book block BB are accurately positioned in known positions relative to side plate 19 and stop plate 21. It will be further understood that these tappers will overcome any static electricity charges carried by the pages so that the pages of the book block are uniformly arranged relative to one another and relative to the side plate and stop plate of the accumulator so that all pages of the book block are accurately positioned in the accumulator.

It will be appreciated that the apparatus 1 may print, bind and trim a wide range of book sizes and thickness within a limited range. For example, the pages of the book block are preferably printed on a standard size sheets of a suitable paper (e.g., 8½×11, A4, or the like) in known locations on the sheets such that the excess margins of the sheets may be determined by the computer control system CS and such that these excess margins may be trimmed at a trimming station 61 so as to produce a finished book of a predetermined size. For example, in the printing of a typical book block, the matter to be printed will be centered heightwise relative to the spine (e.g., one of the major sides of the sheets) and spaced a short distance (one half of the gutter of the printed book, i.e., the blank space between facing pages of the book) from the major side that will constitute the spine S of the book block BB. In this manner, the margins along the major side of the book block opposite spine S and the margins along the top and bottom side of the book block may be readily calculated by the computer control system CS so that the book may be trimmed to have a predetermined finished dimension. In addition, books of a wide range of thicknesses may be printed, bound, and trimmed by the apparatus 1 preferably ranging between about 50 pages (about 25 sheets) to about 850 pages (about 425 sheets) or more. It will also be appreciated that the size of the book and the number of pages in the book block for a particular book are part of the information regarding the printing and binding and trimming of the book given to the computer control system CS controlling operation of the apparatus.

Figure 8:
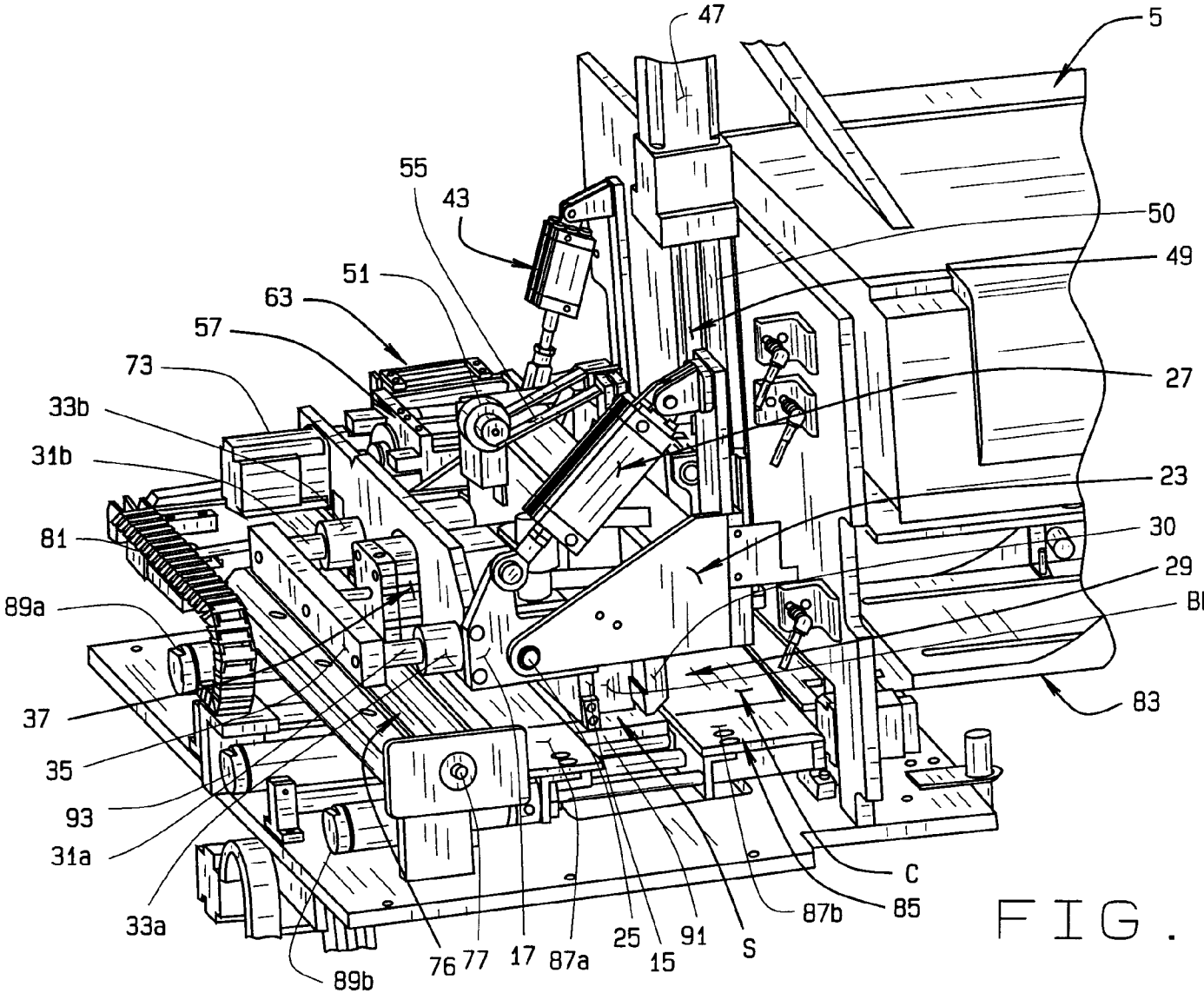
FIG. 8 is a perspective view of the accumulator/fixture holding the book block vertically at the binding station after adhesive has been applied to the spine, the binding station having a binding clamp engageable with a cover (shown in phantom) positioned above the binding clamp for clamping the cover to the spine and to the sides of the book block proximate the spine thereby to bind the cover to the spine of the book block.

As noted, once accumulator 11 is moved from its inclined to its vertical position as shown in FIG. 4, the accumulator is movable vertically downwardly along the workpath WP toward an adhesive application station 57 below the first position of the accumulator, then to a binding station 59 below the adhesive application station (as shown in FIGS. 3-5), and then to trimming station 61 (as best illustrated in FIGS. 10-17) located generally below the binding station. At the adhesive application station 57, a suitable adhesive, preferably a liquefied hot melt adhesive is applied to spine S of the book block BB, preferably, but not necessarily, in the manner as hereinafter described. The book block is then promptly moved further downwardly to binding station 59 where a cover C (a portion of which is shown in FIG. 8) has been pre-positioned so that a desired area of the inner face of the cover, preferably the center portion of the cover, is positioned to be adhesively joined to the spine. Cover C is preferably printed in cover printer 5 while the pages of the book block are printed by page printer 3, but it will be understood that cover C may be pre-printed and delivered to apparatus as required.

Figure 6:
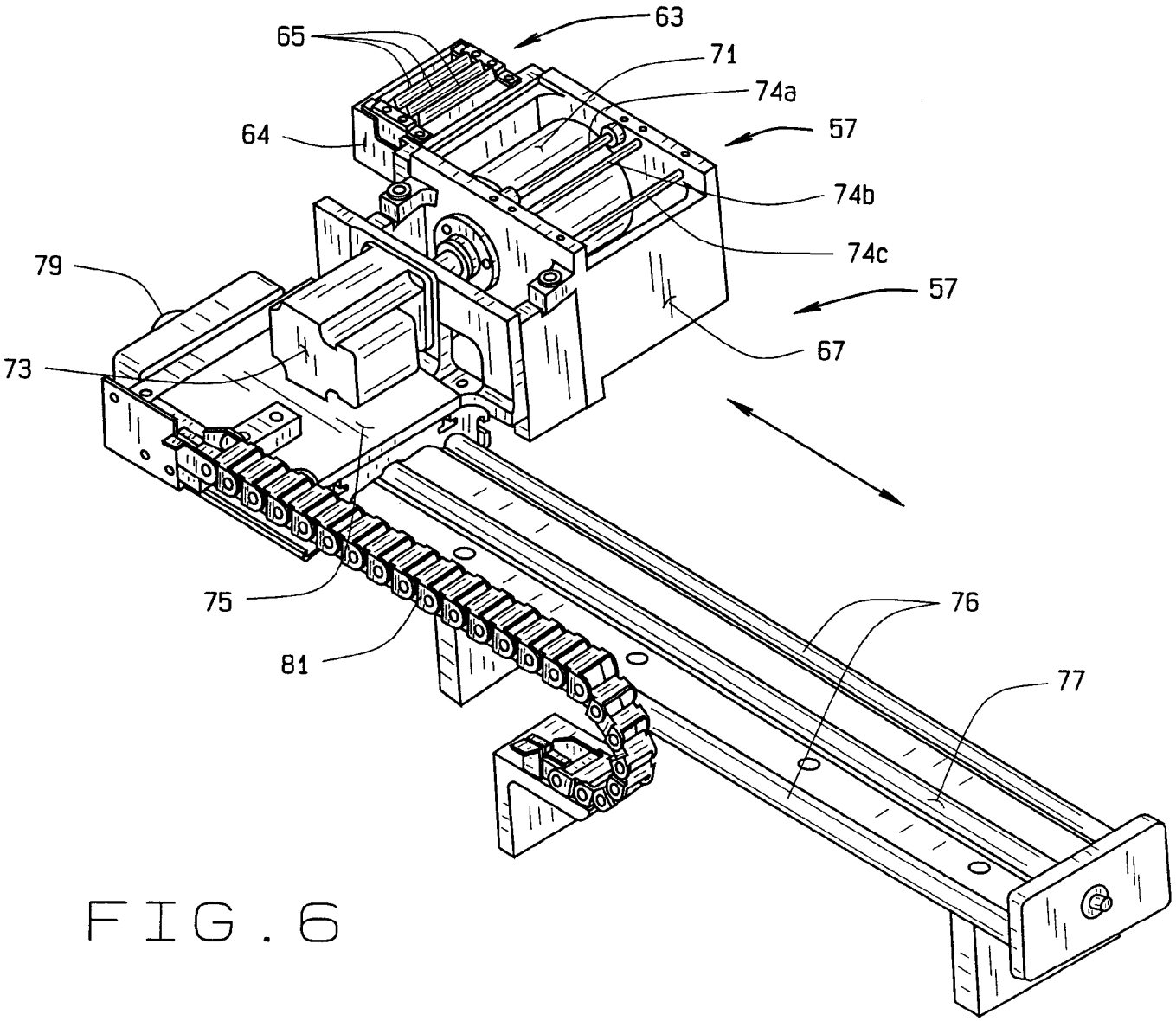
FIG. 6 is a perspective view of the adhesive application station shown in FIG. 3 having a roughener for roughening the spine of the book block and a glue pot or adhesive reservoir which contains a bath of a liquid adhesive (preferably a liquefied hot melt adhesive) and which has a rotary driven adhesive application drum or wheel partially immersed in the adhesive for applying a coating of adhesive to the spine of the book block, with the roughener and the adhesive reservoir being movable lengthwise of the spine of a book block positioned at the adhesive application station to roughen the spine and then to apply adhesive to the roughened spine.

As best shown in FIGS. 6, 7 and 13, adhesive application station 57 includes a spine roughener 63 having a blade housing 64 with one or more blades 65 positioned to extend transversely to spine S. These blades are preferably sharp blades have their cutting edges facing upwardly and are biased upwardly by springs 66 (see FIG. 9) so that their cutting edges are generally coplanar, with the cutting edges being disposed to firmly engage the spine of the book block as the roughener is moved lengthwise along the spine so that the blades will scrape along the length of the spine over the full width of the spine so as to roughen the edges of the paper sheets forming the book block spine. It will be appreciated that by providing stationary blades 65 for roughening the spine as the blades are moved relative to the spine, the need for an electric motor to drive the prior rotary spine milling devices, such as shown in the above-noted U.S. Pat. No. 7,014,182, has been eliminated. Advantageously, the stationary blades do not generate substantial amounts of paper residue as such prior rotary milling devices so there is less debris to be disposed. By roughening the spine prior to application of the adhesive, this better enables the liquid adhesive to wet the spine so that the adhesive will better adhere to the spine. It will be understood, however, that the rotary milling station as described in the above-noted U.S. Pat. No. 7,014,182 may be used in place of the above-described roughener 63. It will also be understood that the adhesive applicator, as described in the '182 patent, may be used in place of the adhesive application system described below.

Figure 9:
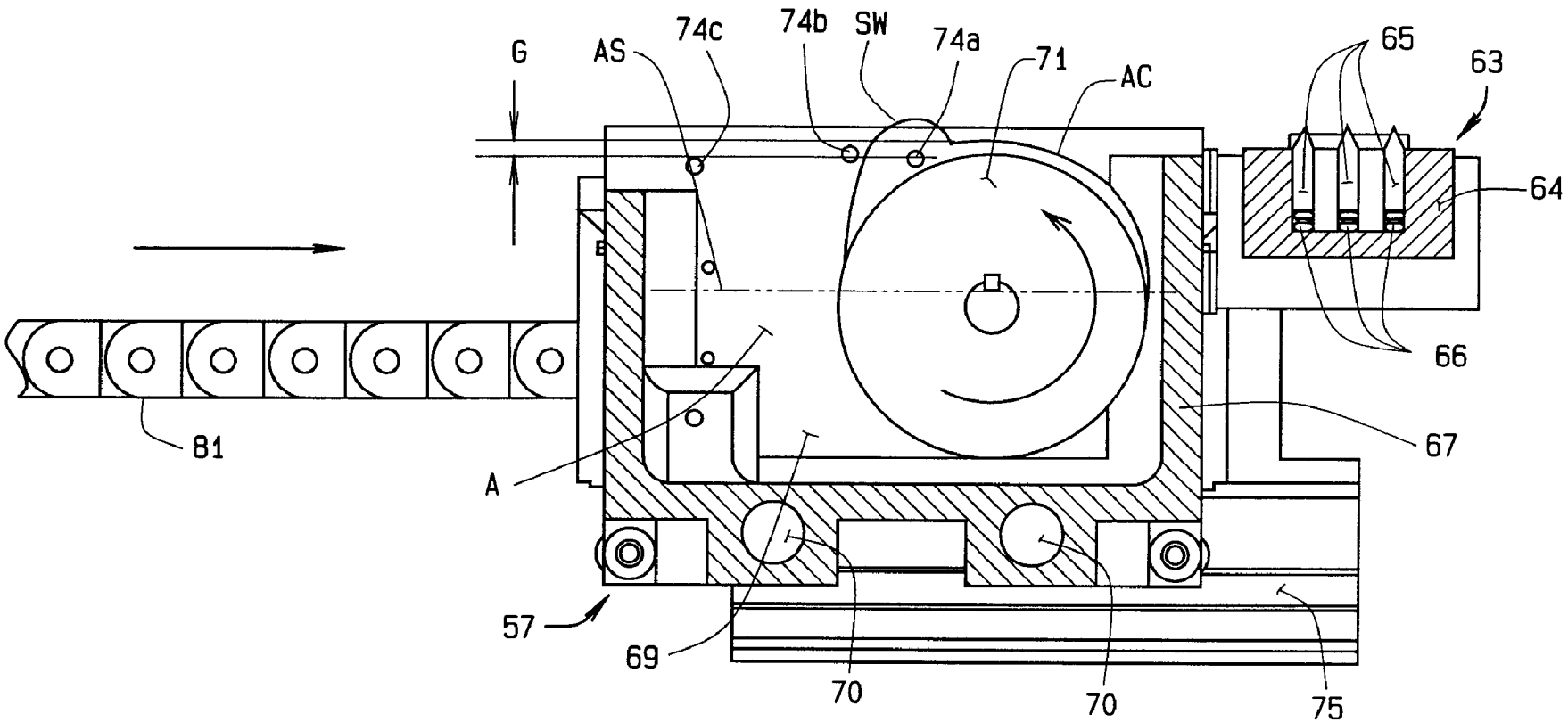
FIG. 9 is a cross sectional view of the adhesive application station illustrating a rotary adhesive application drum as it is partially immersed in a reservoir or bath of liquid hot melt adhesive and illustrating a coating of adhesive coating the peripheral surface of the drum, and further illustrating a standing wave of increased thickness of the adhesive on the upper regions of the drum for application to the spine of the book block.

Adhesive application station 57 further includes an adhesive reservoir (sometimes referred to as a glue pot) 69 of a size (volume) so as to contain a sufficient supply of liquefied hot melt or other adhesive A (as shown in FIG. 9) so as to bind a number of books before more adhesive must be added to the reservoir. Adhesive pot or reservoir 59 is preferably heated to an elevated temperature if a hot melt adhesive is used by means of electric resistance cartridge heaters 70 (See FIG. 9) incorporated in the reservoir and controlled by an automatic temperature control (not shown) well known to those of ordinary skill in the art. Depending on the particular hot melt adhesive used, the adhesive is heated to a temperature sufficient to melt and to liquefy the adhesive and then is maintained at a desired application temperature without undue degradation of the adhesive over an extended period of time. For example, this temperature may range as high as about 400° F. or more, depending on the particular adhesive used. One adhesive that has been satisfactory in the binding of POD books is adhesive HM8101 commercially available from Capital Adhesives of Mooresville, Ind. This adhesive is commercially available in various forms, such as briquettes or pellets, which may be added from time to time to reservoir 69 so they will be melted and thus replenish the supply of adhesive in the reservoir. As illustrated in FIG. 9, the upper surface of the adhesive A in reservoir 69, as shown in phantom and as indicated at AS, is approximately at the level of the shaft about which wheel 71 is rotated. However, it will be understood that the level of the adhesive can vary considerably. Of course, after a predetermined number of books have been bound, a warning can be sent by the computer control system CS for the operator to replenish the amount of the adhesive in the reservoir.

Adhesive application station 57 includes an adhesive application drum or wheel 71. This drum is rotatably mounted with respect to reservoir 69 for rotation about a horizontal central axis such that the lower portion of the wheel is immersed in the above-noted liquefied adhesive in the reservoir 69. The wheel 71 is rotatably driven by a variable speed drive motor 73. This motor may be energized by the computer control system CS just prior to the application of adhesive to the spine S of a book block so that as the drum rotates up out of the adhesive, its outer peripheral surface carries a coating of the liquefied adhesive AC thereon which is applied to the spine of the book block, preferably in the manner as will be described below. It is understood that because the drum is partially immersed within the heated adhesive within the reservoir, the drum is also heated to an elevated temperature and thus helps maintain the elevated temperature of the adhesive on its peripheral surface prior to application to the spine. This helps insure that the adhesive will have adequate working time to be moved from the adhesive application station to the binding station 59 so that cover C is properly adhesively bound to the spine of the book block.

As shown in FIG. 9, as drum 71 rotates up out of the adhesive in reservoir 69, the adhesive coating AC distributes itself over the peripheral surface of the drum so as to form the above-noted adhesive coating across the width of the drum and around the drum at least a portion of the periphery of the drum. At the top of the drum the adhesive coating AC encounters a first wiper bar or rod 74*a* extending transversely of the width of the drum and positioned somewhat closer to the drum than the adhesive thickness AS, which causes the adhesive coating for form a standing or stationary wave (or bulge) SW proximate the rod 74*a*, as shown in FIG. 9. This standing wave SW is a region of increased adhesive thickness at the top of drum 71 for purposes as will appear. The height of this standing wave is dependent on the speed at which the drum is rotated, the temperature of the adhesive coating, and the properties of the adhesive.

As shown in FIG. 9, after the standing wave SW flows over wiper bar 74*a*, the adhesive coating slumps back onto the peripheral surface of drum 71. In addition to wiper bar or rod 74*a*, adhesive pot 67 is provided with two additional wiper bars 74*b* and 74*c* extending from one side to the other of the adhesive pot. As noted, the first wiper bar 74*a* is positioned so that it will encounter the above-noted adhesive coating AC on wheel 71 so as to help form standing adhesive wave SW on the drum proximate the first wiper bar. This standing wave SW thus constitutes a "target" of increased adhesive thickness of the drum into which the spine S of the book block may be submerged to substantially uniformly coat the spine S with adhesive across the width of the spine and along its length as the adhesive station 57 is moved lengthwise along the spine. It has been found that this standing wave is stable over a usable range of wheel rotational speeds and over a range of adhesive temperatures. The second wiper bar 74*b* strikes off excess adhesive applied to the spine, and the third wiper bar 74*c* catches any drips or strings of adhesive that may extend down from the spine so as to prevent these drips from being carried to the inside face of cover C during the binding operation.

As shown in FIG. 6, adhesive application station 57 and spine roughener 63 are mounted on a carriage 75, which in turn is movable along a path or track 76 relative to a stationary book block BB and spine S held in place by the accumulator or first clamp 29 (see FIG. 7) at the binding station 59. This movement of the adhesive application station 57 and the spine roughener 63 relative to the stationary book block is shown to be carried out means of a drive screw 77 rotatably driven by a suitable reversible drive motor (preferably a stepper motor) 79, where the drive screw is threadably engaged with carriage 75. For example, motor 79 may be a stepper motor under the control of the computer control system CS of the apparatus 1. The direction of movement of the adhesive application station 57 relative to a stationary book block BB held by accumulator clamp 29 at the adhesive application station 57 for roughening the spine and for applying adhesive to the spine is shown by the arrow in FIG. 9.

Wheel or drum 71 may be driven by motor 73 in a direction (as shown by the arrow in FIG. 9) such that the top of the wheel operatively engages, but is spaced slightly below, spine S for the application of adhesive to the spine. More particularly, the upper reach of the wheel is separated from the spine by a gap G, as shown in FIG. 7, so as to apply adhesive to the spine S. As described in detail below, it has been found that by varying gap G, the amount of adhesive applied to the spine may be varied. It has also been found that by varying the gap G in relation to the thickness of the book block BB (the number of pages in the book block) different thicknesses of adhesive may be applied to thin and to thick book blocks so as to insure that books of all thicknesses within a limited range, for example books ranging between about 50 pages (about 25 sheets) and over 850 pages (425 sheets) or more, may be more uniformly bound. It will be understood that books having considerably fewer than 25 sheets are not practical to bind a cover to the spine because the spine of the book block is not sufficiently wide to make a good bond with the cover. It has been further found that books having more than about 850 pages (425 sheets) are pose problems with the resulting book being difficult for a reader to open and for the pages to remain open. However, books having fewer than 25 sheets and more than 425 sheets may be printed, bound and trimmed by apparatus 1. It has also been found that 850 pages will cover the vast majority of books to be printed.

Wheel 71 may be rotated in either direction to apply adhesive to spine S. That is, as shown in FIG. 9, wheel 71 may be rotated in counterclockwise direction (as shown by the direction of the arrow) so that the wheel "rolls" along the spine (even though the topmost surface of the wheel does not touch the spine) to apply the adhesive. In this mode of operation, the surface speed of the rotating wheel may nearly match the lineal speed at which the adhesive application station 57 is moved along track 75 relative to the stationary book block BB. This results in an even application of a coating of the adhesive on the spine.

It has been found that if wheel 71 is rotated in the opposite (clockwise) direction from that shown in FIG. 9, wiper rods 74*a-c* should be moved to the opposite side of the top of wheel 71 from its position shown in FIG. 9. With the wheel rotated in such clockwise direction and when the adhesive station is moved relative to the spine and when the spine first encounters the adhesive on the wheel, a large build-up of adhesive will result at the leading end of the book block spine S.

It will be appreciated that the above-noted standing wave SW formed on the periphery of wheel 71 will be so formed regardless of the direction of rotation of the wheel. When the wheel is rotated in the direction opposite to the direction of movement of the wheel relative to the stationary book block spine S and when it is desired to apply a heavy coating of adhesive to the spine, the wheel is rotated at a speed by motor 73 such that the standing wave will be formed at the upper reach of the wheel rotating into the spine in timed relation to the spine entering the adhesive application zone (e.g., the upper surface of wheel 71). This avoids the build-up the adhesive on the leading end of the spine, but allows adhesive to be applied to the spine at a faster rate than if the wheel is rotated in the direction of travel of the adhesive application station. Alternatively, this same result could be achieved by speeding up the rotation of the wheel 71 after the leading end of the spine has entered the adhesive application zone. By increasing the speed of rotation of the wheel, the height of the standing wave SW is increased. By applying adhesive to the spine at a faster rate and in an excess amount and then wiping off the excess adhesive, the adhesive will better wet the edges of the text pages making up the spine S and will better penetrate between the individual pages of the book block at the spine.

More particularly, carriage 75 on which adhesive application station 57 and spine roughener 63 are mounted is slidably movable along track 76 generally lengthwise of spine S of the book block BB from an initial position at the right-hand end of the track (as viewed in FIG. 5) in which the roughener is clear of the first end of the book block spine S to be roughened. From this initial position, the adhesive application station 57 is movable lengthwise along the entire length of the spine so that the roughener may roughen the entire length of the spine and so that the adhesive application drum 71 to apply adhesive along the entire length of the spine and across the entire width of the spine. It will be appreciated that the speed of the relative movement of the adhesive application station 57 and spine roughener 63 may be increased or decreased by varying the speed at which motor 79 and drive screw 77 are driven. Electric wires for the drum drive motor 73, the reservoir heaters 70, and any instrumentation wiring (not shown) are carried in a flexible cable tray 81 to permit the adhesive application station 57 and spine roughener 63 to be reciprocated along track 75 without damage to the wires.

As noted above, the thickness of the adhesive coating AT applied to spine S by the adhesive application station 57 may be controlled or varied by adjusting gap G (see FIG. 7) between the spine of the book block and the topmost surface of wheel 71. As noted, accumulator 11 may be moved vertically along workpath WP by drive motor 47 and drive screw 49. Motor 47 is preferably a stepper motor under the control of the computer control system CS. As previously described, because the lower edges of the paper sheets comprising the book block BB are forced against stop plate 21 by tap fingers 55 each time page tapper 51 is actuated (preferably after each sheet is deposited in the accumulator), and because accumulator clamp 29 securely holds the book block in place on the accumulator bed 15, when the accumulator has the book block in the position shown in FIG. 7, the vertical position of spine S is "known" to the computer control system.

As noted, motor 47 driving drive screw 49 is preferably a stepper gearmotor, as is readily commercially available from a number of sources. Such stepper motors are typically provided with an encoder (not shown) that has a predetermined number of counts for each revolution of the drive shaft of the motor. For example, motor 47 may have 2048 counts for each revolution of its drive shaft and for each revolution of the drive screw. Drive screw 49 is preferably a threaded lead screw (or ball screw) and as such has a known pitch (i.e., the distance between two adjacent threads). For example, drive screw 49 may have a pitch of 0.25 inches (6.35 mm.). Thus for motor 47 and for drive screw 49 in the above example, the resolution of the drive is 0.25 inches/2048 counts=0.000122 inches (0.0031 mm.) for each count. It will be understood that this is only one example of the number of counts for the stepper motor encoder and for the pitch of a particularly drive screw. Those skilled in the art will appreciate that other stepper motors, drive screws and, in fact, other linear actuators, may be used in place of motor 47 and drive screw 49 in the above example.

More particularly, using the numbers of the above example, drive 45 has a "home" position know to the computer control system CS, where this "home" position is used as a reference position for the book block as it moves along workpath WP. Thus, when the accumulator mounting frame 23 is in its fully raised position (as shown in FIGS. 2-4) in which the accumulator 11 is in its inclined position to receive the printed text pages and to form (collate) the book block BB on accumulator bed 15, the position of the mounting frame 23 relative to the home position is known to the computer control system. Likewise, the vertical position of the mounting frame is known to the computer control system at any position along track 50. Thus, the computer control system CS "knows" the position of the book block BB and of the spine S when the book block is in position at the adhesive application station 57, at the binding station 59, and at the trimming station 61. Because the book block is accurately positioned in the accumulator 11, as described above, the position of the book block and spine S are accurately known to the computer control system as the book block is moved to the various stations and can be controlled by the computer control system with great accuracy, theoretically to within about ±0.000122 inches (0.0031 mm.), as shown by the above example. By adjusting the height of the spine at the adhesive application station 57, the width of gap G may be controlled. This allows for the application of adhesive to the spine to be varied in relation to the thickness of the book block, it allows the book block spine to be accurately positioned with respect to a desired position relative to the cover C at the binding station 59, and allows the position of the bound book to be accurately known to the trimming station 61 so that the margins of the book may be trimmed with good accuracy to produce a book of a known predetermined size. Because each book produced by the apparatus 1 may be of a different size and/or thickness, as compared to the next or last book to be produced, and because the computer control system CS is given information concerning the size of the book block and the number of pages in the book block, apparatus 1 has the ability to accurately control the thickness of the adhesive applied to the spine, the ability to accurately place the book block spine relative to the cover, and the ability to accurately trim the margins of the book to predetermined dimensions for the book being printed on demand, apparatus 1 has the ability to accurately print, bind and trim books in a wide variety of sizes and thicknesses one after the other in a fully automatic mode with no operator intervention.

As noted, the thickness of the coating of adhesive applied to the spine S at the adhesive application station 57 may be varied in relation to the thickness of the book block of the book then being printed and bound. It will be appreciated that a first book to be printed, bound and trimmed by apparatus 1 may be relatively thin (e.g., 100 pages or 50 sheets) and the next book may be thick (e.g., 850 pages or 425 sheets). It has been found to be desirable to vary the thickness of the adhesive applied to the spine of book blocks in relation to the thickness of the book block. This is accomplished by varying the width of gap G (as shown in FIG. 7 and in FIG. 9) between spine S and the upper reach of adhesive wheel 71 by accurately controlling the vertical position of the spine S relative to the topmost surface of wheel 71. In the example above, the spine of the book block spine is lowered by drive 45 until it is positioned a predetermined distance from its home position, which as indicated may be an arbitrary reference position, thereby to establish an initial thickness of gap G. For example, it has been found that if the position of the spine is about 68,430 counts from its home position, gap G will be such that a suitable thickness of adhesive will be applied to a thin book block (e.g., a book block having about 50 pages or about 25 sheets). It has been found that if the thickness of the adhesive coating applied to spine S is varied in accordance with the thickness of the book block or spine, a better book block-to-cover binding is accomplished. This variance of the adhesive thickness corresponding to the thickness of the book block has been found to be approximated by the relationship $AT=b+mX$, where AT is the adhesive thickness applied to the spine, b is a constant representing the initial position of spine S (expressed in counts) relative to the above-noted home position so as to establish a minimum width of gap G, and mX is a function of the number of pages in the book block also expressed in counts. More specifically, it has been found that if X is the number of sheets of paper in the book block (i.e., about half the number of pages in the book block) and if m=0.5, the adhesive thickness AT applied to the spine will result in the satisfactory binding of covers to books having a range of thickness between about 50 pages (about 25 sheets) and a thick book having about 850 pages (about 425 sheets). However, it will be appreciated that the numbers of the above relationship can be varied widely (e.g., plus or minus 30% or more) and still satisfactory binding of thin, thick and intermediate thickness books will result. This variance is due to differences in the adhesive used, the temperature of the adhesive, and the physical properties of the paper in the book block, primarily the wetting characteristics of the paper and the adhesive.

For example, if a book containing 500 pages (250 sheets) in its book block BB is to be bound, the number of pages (or sheets) in the book block is made known to the computer control PLC. In accordance with the above relationship, $AT=b+mX$, where b is an initial position (e.g., 68,430 counts), where m is a constant factor (e.g., 0.5), and where X is the number of pages in the book block, in counts. Thus, for a book having 250 pages, the adhesive thickness AT=68430+(0.5×250=125 counts)=68,555 counts. Of course, where one count=0.25 inches/2048=0.000122 inches/count, the gap G would be increased about 0.015 inches (0.38 mm.). In another example, if the thickness of the book block is 850 pages (425 sheets), the width of gap G would be increased about 0.025 inches (0.66 mm.).

Alternatively, instead of approximating the thickness of the book block BB by taking into account the number of pages or sheets in the book block and then varying the thickness of the adhesive applied to the spine S, as described above, it has been found that in certain situations it may be desirable to accurately measure the thickness of the book block to be bound after it has been firmly clamped in accumulator clamp 29. It will be appreciated that a number of factors in addition to the number of pages or sheets of paper may affect the thickness of the book block. For example, the type of paper used and the ambient humidity will impact the thickness of the book block. Exposure of the paper to excessive humidity for a sufficient time will cause the thickness of the paper sheets to swell. Further, using a heavier paper will increase the book block thickness in ways that cannot be predicted merely by relying on the number of pages or sheets in the book block to estimate the thickness of the book block.

More specifically, the true thickness of the book block BB as it is clamped in accumulator clamp 29 may be determined by mounting a laser measuring device, as best shown at 82 in FIG. 2, and accurately measuring the thickness of each book block BB after it has been printed and before it is bound to its cover C. By way of example, laser measuring device or sensor 82 is shown to be mounted on clamp member 30 in a position where it will be clear of the book block and where it has an unimpeded view of accumulator bed 15. In this manner, after accumulator clamp cylinder 37 has been actuated so as to firmly clamp the book block in clamp 29, the laser measuring sensor can accurately measure the distance between clamp member 30 and bed 15 thereby to accurately determine the thickness of the book block, as it was printed. One such laser measuring device may be a laser measurement sensor, such as an Acuity AR200-50 sensor, commercially available from Schmitt Measurement Systems, Inc. of Portland, Oreg. This laser measuring sensor 82 may have an accuracy of about 0.03 mm. (0.001 inches). Of course, other such laser measuring sensors are available from other manufacturers and will work well in this application. Those skilled in the art will recognize that other devices may be used to accurately measure the thickness of the book block as it is clamped in accumulator clamp 29. One such other device that may be used in place of a laser measurement sensor is a linear variable differential transformer (not shown), which may be mounted on clamp cylinder 37 may be used to accurately determine the spacing of accumulator bed 15 and clamp member 30 and hence the thickness of the book block.

In such a system using a laser measuring sensor 82 or a linear variable differential transformer to determine the thickness of the book block spine S and to adjust the width of gap G (as shown in FIGS. 7 and 9), the above-described relationship AT=b+mX may be employed where AT and b have the meanings discussed above, where m is a correction factor, where X is the measured thickness of the book block, and where mX is expressed in a number of counts related to the measured thickness of the book block. For example, for a book block that is measured to be 1.00 inches thick (i.e., where X=1.00 inches), m may be equal to, say, about 0.015 so that mX is equal about 123 counts. Using the above example, if b=68,430 counts and if the measured thickness of spine S=1.00 inches, then the thickness of gap G for this 1.00 inch thick book block would be increased about 123 counts, or AT=68,430+123=68,553 counts.

After adhesive is applied to spine S, the adhesive application station 57 latter is moved to a position clear of the spine (as shown in FIG. 6), and drive 45 is initiated to move the book block BB held by clamp 29 from the adhesive application station 57 to binding station 59. It will be appreciated that a cover C for the book being printed may be printed by cover printer 5 while the page printer 3 prints the pages for the book block. Upon cover C being printed by the cover printer, the cover is delivered to the binding station or binding table 59 by means of a cover conveyor 83. Alternately, a pre-printed cover may be delivered to cover conveyor 83. This cover conveyor has power driven rollers 84 (as shown in FIG. 3) driven by motors (preferably stepper motors) that in turn are under the control of computer control system CS so that the cover may be accurately positioned with respect to binding station 59 so as to align a desired portion of the cover (typically the center or the spine of the cover) with the center of spine S of the book block thus enabling the spine of the book block to be joined to the cover along the predetermined area of the cover to form a bound book B.

The accurate determination of the book block thickness also allows the computer control system to print the cover C for that book block in such manner that the width of the cover spine may be adjusted so as to accommodate thicker or thinner book blocks and in such manner that the front and back faces of the cover may be printed on the cover stock in such manner that the front and back faces of the cover are properly spaced in relation to the adjusted width of the cover spine. In this manner, with the centerline of the cover spine in register with the centerline of spine S of the book block, the front and back faces of the cover will properly overlie the front and back faces of the book block. Accordingly, when the bound book is trimmed, the cover will be in the proper position with respect the front and back faces of the book block such that when the book is trimmed, the cover will be in proper timed relation relative to the book block.

By actually measuring the true thickness of the book block BB as the book block is held in clamp 29, the true centerline of the book block may be determined. As will be appreciated, one half of the measured book block thickness is the true centerline of the book block. More specifically, the distance from accumulator bed 15 (which constitute a reference surface for the book block) plus one half of the measured thickness of the book block gives the location of the true centerline of the book block relative to bed 15. It will be further appreciated that because the bed 15 serves as the reference surface for the book block as the book block and the bound book are moved to the adhesive application, then to the binding station, and then to trim station 61 such that the position of the book block and the bound book is known to the computer control system CS. In turn, by determining the true centerline of the book block as it is held by clamp 29, the computer control system CS will then "know" the position of the true centerline of the particular book block about to be bound in binding station 59. By knowing the true centerline and thickness of the spine S of the book block BB of each book about to be bound, the computer control system may adjust where cover printer 5 prints the front cover image, the spine image, and the back cover image on the cover stock so that for the book being printed and bound by apparatus 1 the spine of the cover is properly in register with and is the same width as the spine S of the book block, and so that the front and back covers of cover C are in proper register with the front and back faces of the book block. It will be appreciated that this takes changes in the thickness of the book block that may result from humidity and a change in the paper stock used to print the book block.

As noted, if the paper is exposed to high humidity levels prior to the book block being printed, the book block may be appreciably thicker than if the book block would be printed on "dry" paper that had not been exposed to these high ambient humidity levels. In some cases, the thickness of a thick book block of 400 sheets could vary about 0.10 inches to about 0.20 inches (2.5-5 mm.) because of the effect of humidity on the thickness of the paper sheets. Likewise, if a book block is printed on different paper stock, this can appreciably increase or decrease the thickness of the resulting book block. These differences in book block thickness for the same book and cover may have the effect of making cover spine (i.e., the center portion of the cover that ideally is in register with book block spine S) for that book to be too small to fit the thicker book blocks or too big to fit the thinner book blocks. In turn, this oftentimes gives the finished book the appearance of having an ill-fitting cover.

By actually measuring the thickness of the book block, the centerline of the book block can be determined. Further, upon measuring the thickness of the book block as it is actually printed, this actual thickness will reflect changes in book block thickness due to the paper having absorbed moisture or from being on thicker or thinner paper. This information can then be fed in to computer control system CS to modify the width of the cover spine, and the position of the front and back images of the cover and where they are printed on the cover stock in relation to cover spine.

With the cover C having been printed in relation to the thickness of the book block to which it will be bound and with the position of the true centerline of the book block and the true centerline of the cover having been established, it will be appreciated that as cover C is fed by cover conveyor 83 onto binding table 85, the cover can be accurately positioned on the binding table such that the centerline of the cover will be in register with the centerline of the book block spine when the book block is brought into binding relation with the cover. More specifically, the size of the cover stock upon which cover C is printed by cover printer 5 is known. For example, the cover stock may be 11×17 stock. As noted, the front, spine and rear images of the cover may be printed on the cover stock in predetermined locations. As the cover stock is conveyed to the binding table or clamp 85 by cover conveyor 83, rollers 84 are controlled by stepper motors under the control of the computer control system. A photocell 86 is positioned relative to the cover conveyor that senses the leading edge of the cover C as the cover is conveyed to the binding table. This photocell also senses when the trailing edge of the cover has moved clear of the photocell so as to generate a signal to the computer control system so as to terminate operation of cover conveyor. Then, the stepper motors driving conveyor rollers 84 may be operated in reversed to as to back up cover C so that the centerline of the cover is in register with the centerline of the book block. In this manner, the centerline of the book block and the centerline of the cover are in register with one another.

As shown in FIG. 8, binding station or binding table 59 has a binding clamp, as generally indicated at 85, having a pair of self-centering binding clamp jaws 87*a*, 87*b* that are movable in horizontal direction perpendicular to the sides of the vertically disposed book block BB between a retracted position in which the jaws are clear of the book and a clamping position in which the jaws engage the cover C positioned at the binding station and the book block BB adjacent spine S. When in their clamping position, these clamp jaws forcibly press the cover against the sides of the book block. This in turn adhesively binds the cover to the spine to the spine of the book. The clamping jaws are moved between their retracted and clamping positions by fluid cylinders 89*a*, 89*b*, preferably air cylinders.

As indicated at 91 in FIG. 8, a retractable floor plate or bed is provided at binding station 59 below clamping jaws 87*a*, 87*b* for supporting cover C and book block spine S between the clamping jaws as the clamping jaws close on the cover and book block. During binding, floor plate 91 provides a solid surface to support the book block and the cover and gives support to the cover as the book block is moved downwardly into binding engagement with the cover. It will be understood that as accumulator clamp 29 moves the spine S of the book block BB into engagement with the center portion of cover C, the book block spine forces the cover downwardly into engagement with floor plate 91. This insures that the cover is in contact with the adhesive on the spine as the clamp jaws close. It will be appreciated that the clamp jaws 87*a*, 87*b* remain in their closed position holding the cover on place on the book block for a time sufficient (e.g., a few seconds) to allow the adhesive to set and to adhere the cover to the spine. Upon completing binding of the cover to the book block, a fluid cylinder 93 is actuated to retract bed plate 91 so as to clear a path through the binding station when clamp jaws 87*a*, 87*b* are open to permit the bound book to be conveyed downwardly to the trimming station 61 in a manner as will appear.

More specifically, upon binding of the cover to the book block and while the now bound book B is still gripped by clamp jaws 87*a*, 87*b* so as to permit the adhesive to bind the cover to the spine of the book block, accumulator clamp 29 is operated to release its grip on the book block BB proximate spine S, and drive 45 is actuated to move the accumulator clamp upwardly toward the top edge of the book block distal from the spine. There, accumulator clamp cylinder 37 is actuated so as to re-grip the book block adjacent the top edge of the book block so that as the book is re-gripped, its position is known to the computer control system CS. Then, cylinder 93 is actuated so as to retract binding floor 91, clamp jaws 87*a*, 87*b* are opened, and drive 45 is actuated so as to lower the bound book spine first between the open clamp jaws toward trimming station 61. As the bound book B is moved downwardly between the open jaws 87*a*, 87*b*, the cover will be swept inwardly toward the book block by the jaws. It will be appreciated that when the clamp 29 re-grips the book block adjacent the top edge of the book block, the position of the book block and hence of the bound book B in both heightwise and widthwise direction continues to remain known to the computer control system CS.

U.S. patent application Ser. Nos. 61/234,800 and 61/234,882, filed contemporaneously with this present application are herein incorporated by reference in their entirety.

In operation, a POD book to be printed is selected by a customer or by another person operating apparatus 1. It will be understood that a library of POD books is available, which library may contain a large number of books. Once a book is selected, the data corresponding to the text of the book is sent to text page printer 3 and the data corresponding to the cover for the selected book is sent to cover printer 5. These printers begin to print the book block BB and cover C for the selected book. Preferably, a wide variety of sizes of books may be printed on demand on a standard size paper, such as 8½×11. The text for the text pages of the book is centered heightwise on the page and is printed a prescribed distance from one major (long) edge of each text page that this one major edge will constitute the spine S of the book block BB. This in turn allows the control system to "know" what margins of the bound book must be trimmed from the book block in order to produce a finished book of predetermined size. Other data corresponding to the book to be printed (e.g., the number of pages in the book, the finished trim size along each edge of the book, and the like) may be sent to computer control system CS for purposes as will appear, below.

With accumulator 11 in its first position, as shown in FIG. 2, pages printed by the page printer 3 are preferably de-curled by de-curler 13 and are deposited on the accumulator bed 15. As each page or small group of pages is deposited on bed 15, page tappers 51 and 53 are actuated so as to insure that one edge of each page (or small group of pages) of the book block being formed is in firm engagement with stop plate 21 and with side 19 thus positioning the book block in a known position within the accumulator/fixture 11. When page printer 3 has completed printing all of the pages of the book block and when all of the pages have been accumulated in the accumulator 7, accumulator clamp 29 is actuated by means clamp cylinder 37 so as to firmly clamp the book block in position on the accumulator bed 15. Then, cylinder 43 is actuated so as to pivot stop plate 21 to its retracted position clear of the spine S of the book block. Then, accumulator pivot cylinder 27 is actuated so as to pivot accumulator frame 17 from its inclined position (as shown in FIGS. 2-4) to its vertical position (as shown in FIG. 5). As previously noted, when the stop plate 21 is moved to its retracted position and when the book block is clamped in the accumulator, the accumulator bed 15 and the clamp 29 are positioned in spaced relation to the spine S such that about ⅜ inches (9.5 mm.) of the book block proximate the spine is exposed.

With the adhesive application station 57 in its ready position (that is, at the right-hand end of track 76, as shown in FIG. 6), motor 47 is energized so as to move the accumulator clamp 29 and the book block BB held by thereby downwardly from the position shown in FIG. 4 to the position shown in FIG. 7 in which the spine S of the book block BB held by clamp 29 is positioned just above the level of adhesive application wheel 71 with a space or gap G between spine S and the upper surface of wheel 71. As previously noted, when a POD is ordered to be produced by apparatus 1, the number of pages in the book block for that book is made known to the PLC computer controller CS. The computer controller positions the spine S in proper position with respect to the top surface of wheel 71 in accordance with the relationship AT=b+mX, as previously described. This, in turn, adjusts gap G so as to vary the amount (thickness) of the adhesive coating applied to the spine in relation to the thickness (either the number of pages in the book block, or the actual thickness of the book block, as measured by laser measuring sensor 82). Motor 73 is energized so as to rotate wheel 71 such that the peripheral surface of the wheel is coated with adhesive, as previously described.

Motor 79 is then energized so as to move spine roughener 63 and adhesive application wheel 71 relative to the stationary book block spine so that the roughener blades 65 will scrap along the spine so as to roughen the edges of the paper sheets comprising the spine. The wheel 71 will apply a desired amount (thickness) of the adhesive to the spine in the manner heretofore described. Upon the adhesive application station 57 to its position, as shown in FIG. 6, in which the adhesive pot 67 is clear of the spine of the book block, motor 47 is further energized so as to move the book block downwardly along work path WP from the adhesive application station 57 to the binding station 59.

As various changes could be made in the above constructions without departing from the broad scope of the invention, it is intended that all matter contained in the above description or shown in the accompanying drawings shall be interpreted as illustrative and not in a limiting sense.

The invention claimed is:

1. Apparatus for binding a perfect bound book, said book comprising a book block and a cover adhesively bound to one edge of said book block, said one edge of said book block being the spine of the book block, said book block comprising a plurality of sheets of paper onto which the text of the book is printed, said cover being adapted to wrap around said spine and to be adhesively adhered to said spine, said apparatus comprising:

a. a fixture receiving said book block;

b. a first clamp for holding said book block relative to said fixture with the spine of the book block exposed for the application of adhesive thereto;

c. an adhesive application station for applying adhesive to said spine of said book block;

d. said fixture being vertically movable from a first position in which said fixture is positioned to receive said book block to a second position in which said book block held by said first clamp is positioned relative to said adhesive application station for the application of adhesive to said spine;

e. a vertical drive including a linear actuator for moving said fixture toward and away from said adhesive application station;

f. said adhesive application station having an adhesive application wheel partially immersed in a supply of liquefied adhesive, said wheel being rotatable about a horizontal axis and said wheel having a coating of said adhesive on its peripheral surface as said wheel rotates up out of said liquefied adhesive;

g. a drive for effecting relative movement of said book block and said adhesive application station for the application of adhesive to said spine of said book block;

h. said wherein said vertical drive is operable to selectively move said book block spine toward and away from said adhesive applicator member so as to vary the thickness of the coating of adhesive applied to said spine by said applicator member in relation to the thickness of the book block of the book block being bound;

i. a computer controller for controlling operation of said apparatus, wherein said computer controller having knowledge of the thickness of the book block being bound and effecting movement of said vertical drive so as to move said book block held thereby toward or away from said adhesive applicator member so as to vary the thickness of said adhesive coating applied to said spine in relation to the thickness of said book block being bound;

j. said adhesive application station having a wiper adjacent said periphery of said wheel for forming said coating applied to said spine to be of a desired thickness;

k. said adhesive application station having a first wiping member extending the width of said wheel and positioned to engage said layer of said adhesive on said wheel so as to further increase the thickness of said adhesive adjacent said first wiper member along a region of said wheel;

l. said adhesive application station having a second wiping member extending transversely of said wheel and positioned closer to said spine than said first wiping member as said adhesive application station is moved relative to said spine thereby to wipe excess adhesive from said spine and to form said coating of adhesive on said spine of said desired thickness; and m. said adhesive application station has a third wiping member extending transversely of said wheel and positioned so as to catch at least some excess adhesive from said book block that may drip therefrom.

2. Apparatus for binding a perfect bound book, said book comprising a book block and a cover adhesively bound to one edge of said book block, said one edge of said book block being the spine of the book block, said book block comprising a plurality of sheets of paper onto which the text of the book is printed, said cover being adapted to wrap around said spine and to be adhesively adhered to said spine, said apparatus comprising:

a. a fixture receiving said book block;

b. a first clamp for holding said book block relative to said fixture with the spine of the book block exposed for the application of adhesive thereto;

c. an adhesive application station for applying adhesive to said spine of said book block;

d. said fixture being vertically movable from a first position in which said fixture is positioned to receive said book block to a second position in which said book block held by said first clamp is positioned relative to said adhesive application station for the application of adhesive to said spine;

e. a vertical drive including a linear actuator for moving said fixture toward and away from said adhesive application station;

f. said adhesive application station having an adhesive application wheel partially immersed in a supply of liquefied adhesive, said wheel being rotatable about a horizontal axis and said wheel having a coating of said adhesive on its peripheral surface as said wheel rotates up out of said liquefied adhesive;

g. a drive for effecting relative movement of said book block and said adhesive application station for the application of adhesive to said spine of said book block;

h. said wherein said vertical drive is operable to selectively move said book block spine toward and away from said adhesive applicator member so as to vary the thickness of the coating of adhesive applied to said spine by said applicator member in relation to the thickness of the book block of the book block being bound; and i. said adhesive application station includes a spine roughener, the latter comprising a plurality of blades extending transversely of the book block spine, each of said roughener blades having a sharpened edge with the sharpened edges of said roughener blades being substantially coplanar and being positioned relative to the spine of a book block positioned at said adhesive application station so as to be engaged by said sharpened edges upon relative movement of said adhesive application station and said book block so that said blades engage said spine along the length of the spine so as to roughen the spine.

3. Apparatus as set forth in claim 2 wherein said blades are resiliently biased toward spine as said roughener moves along said spine.

* * * * *